United States Patent [19]

Johns

[11] B 3,981,219

[45] Sept. 21, 1976

[54] PRACTICE VIOLIN AND BOW

[76] Inventor: Robert H. Johns, 3379 Paper Mill Road, Huntingdon Valley, Pa. 19006

[22] Filed: Sept. 9, 1974

[21] Appl. No.: 504,169

[44] Published under the second Trial Voluntary Protest Program on January 13, 1976 as document No. B 504,169.

[52] U.S. Cl. ..... 84/275; 84/282

[51] Int. Cl.[2] ..... G10D 1/02

[58] Field of Search ..... 84/275–277, 84/282, 173, 291

[56] References Cited

UNITED STATES PATENTS

| | | | |
|---|---|---|---|
| 8,338 | 9/1851 | Tilton | 84/275 |
| 906,612 | 12/1908 | Cayton | 84/275 |
| 2,457,629 | 12/1948 | Beckman | 84/275 |
| 2,466,168 | 4/1949 | Graydon | 84/282 |
| 2,741,937 | 4/1956 | Auville et al. | 84/277 X |
| 2,977,835 | 4/1961 | Hornseth | 84/275 |

FOREIGN PATENTS OR APPLICATIONS

| | | | |
|---|---|---|---|
| 6,340 | 4/1887 | United Kingdom | 84/275 |
| 506,835 | 6/1939 | United Kingdom | 84/282 |

OTHER PUBLICATIONS

The Music Trades, Feb. 1966, p. 94.

*Primary Examiner*—Lawrence R. Franklin

[57] ABSTRACT

A simplified construction for a violin and bow is disclosed. The violin body is made of two arched panels instead of an enclosed chamber. Strings and neck structures are similar to those of traditional instruments. The bow uses nylon string wrapped in lengthwise loops on the bow shaft so that the strings on both sides of the shaft remove most of the bending stress from the bow shaft. The violin and bow are durable and inexpensive, and are suitable for instructing classes of children in schools.

7 Claims, 4 Drawing Figures

PRACTICE VIOLIN AND BOW

This invention relates to improvements in stringed instruments for practice purposes, and improvements in bows for such practice instruments. Although violins are hereinafter referred to, this invention may be incorporated into other members of the viol or violin families, such as bass viols, cellos, violas, or small sized violins.

In summary, this invention provides an improved panel construction for practice violin bodies whereby arched panels coupled by a soundpost radiate more sound. This invention also includes a novel violin bow structure that causes less bending moment on the bow shaft which results in a simple inexpensive bow.

Hornseth, in U.S. Pat. No. 2,977,835, issued Apr. 4, 1961, has a violin body of flat panels, but sound radiation from his violin body is limited by a rigid panel-rib construction.

One object of this invention is to provide an improved construction of a violin for practice purposes, whereby an improved tone and a more rugged instrument shall result.

Another object of this invention shall be to provide a bow suitable for playing a practice stringed instrument that shall be simple, durable, and of low cost.

With these objects in view, constructions that embody the hereinafter claimed structures are illustrated in the accompanying drawing, in which:

Figure 1:
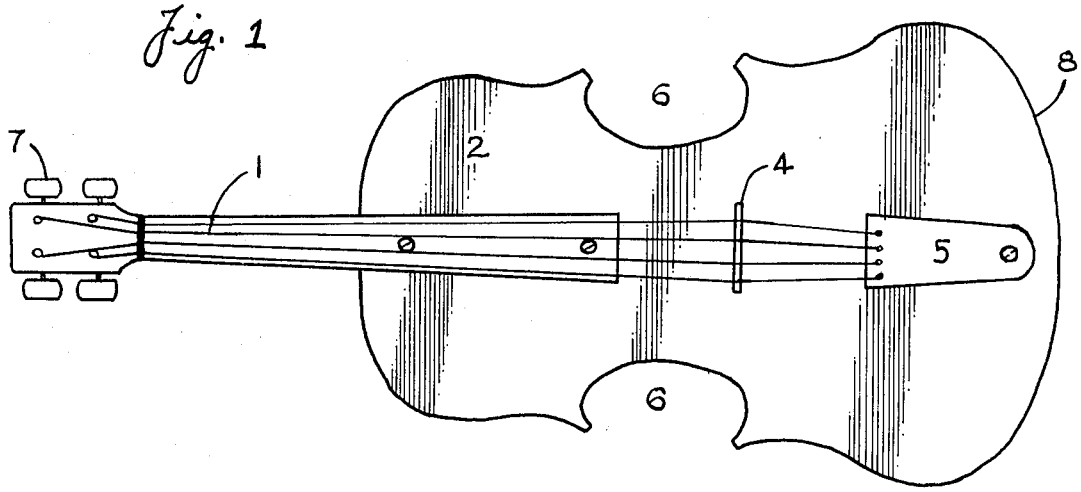
FIG. 1 is a plan view of a practice violin.

There is a persistent need to introduce more children to the study of stringed instruments. Strings are notoriously difficult to play, with a long apprenticeship required before musical results are produced. Violins are also expensive to buy and delicate and fragile to handle.

This invention has as its view the provision of an inexpensive and rugged instrument and bow that can be used by large groups, such as classes employing the Suzuki methods of instruction. The invention also provides a suitable balance between a quiet muted tone that diminishes the raucous noise of beginner, and sufficient reinforcement of string vibration to reward proper bowing and fingering technique of the player.

Referring in more detail to the drawing, the violin strings 1 are stretched between a tailpiece 5 and tuning machines 7 located in the head of the instrument, passing over bridge 4 which transmits string vibrations to the instrument body 2, which is formed to resemble the approximate shape of the traditional violin, with bouts 6 indented to facilitate playing with a bow upon the strings.

Figure 2:
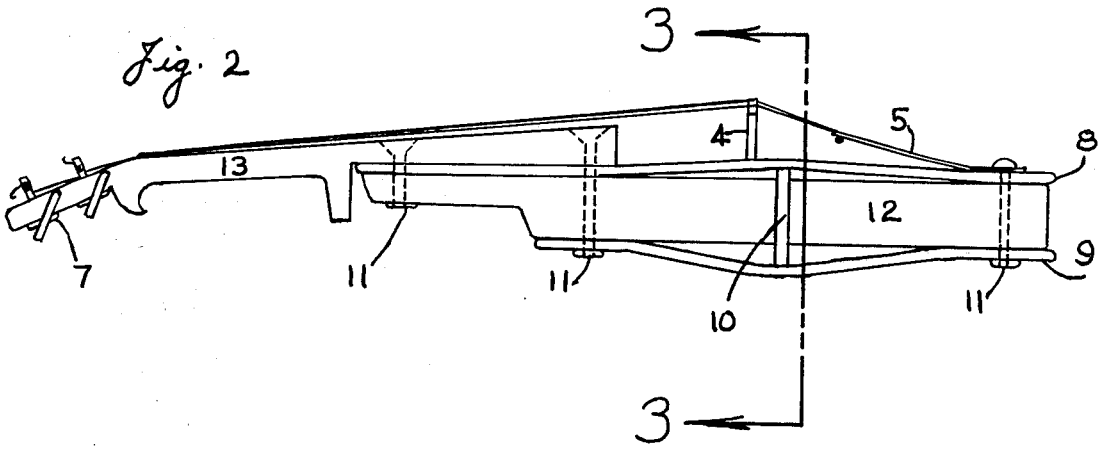
FIG. 2 is a side elevation of a practice violin.
Figure 3:
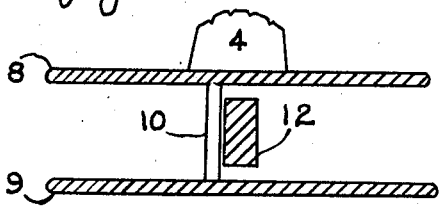
FIG. 3 is a fragmentary sectional detail as taken from indicated line 3—3 in FIG. 2.

Panels 8 and 9 comprising the body are positioned approximately parallel to one another by longitudinal rib 12 which is clamped to neck 13 by bolts 11. Lower panel 9 may be of the same shape as upper panel 8, or it may be smaller, as is indicated in FIG. 2. Soundpost 10 is held by friction between panels 8 and 9. It is of such a length as to hold panels 8 and 9 away from rib 12 and arch them, thereby permitting string vibrations from the foot of bridge 4 to be freely transmitted over a large portion of panel 8 through soundpost 10 to panel 9. The vibrating panels thus radiate sound waves from two surfaces of the instrument.

Figure 4:
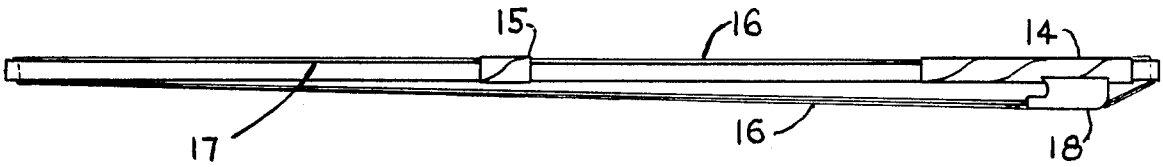
FIG. 4 is a side elevation of a bow.

The bow illustrated in FIG. 4 is made of a thin shaft of wood 17, notched at its extremities to receive a plurality of turns of nylon string 16. A wood spacer or frog 18 holds the strings 16 away from the shaft 17 on one side of the bow for playing, while the other sides of the loops are held contiguous to the shaft by suitable wrapping or coverings 14 and 15. Covering 14 also serves as a handle of the bow. Loosening and tightening bow strings 16 is accomplished by sliding frog 18 lengthwise on shaft 17.

Nylon string or thread, suitably rosined, is a well known substitute for horsehair on instrument bows. This invention, however, provides an improved structure for a bow frame or shaft, whereby the expense and complexity of special woods, warping procedures, and hair tensioning mechanisms are eliminated. By having the taut bow strings placed on both sides of the bow shaft, the shaft approaches a condition of equilibrium, with much less flexing or bending tendency. The shaft approximates the diagonal of a force parallelogram, and does not need to have the strength and rigidity of a conventional bow. An inexpensive soft wood dowel may be used in this bow structure. By means of this invention a low cost, readily produced instrument bow has been realized. Such a bow is an essential companion to a low cost practice violin, since the expense of conventional bows is sufficient to prohibit their use by classes and large groups, even if the instruments were available.

The panels 8 and 9 of the violin body are to be of a durable but yielding material, so that the instrument can absorb the hard knocks, falls, and other abuse likely at the hands of young children. A composition known commonly as tempered hardboard, one eighth inch thick, has been found to be appropriate.

The novel structure that separates panels 8 and 9 from rib 12 by means of soundpost 10 in this invention provides improvement in both loudness of sound and in quality of tone over prior art in practice violins. Hornseth U.S. Pat. No. 2,977,835 discloses a panel and rib structure for his violin body, but limits the plate vibration by securing the panels to the rib over the entire length of the rib, preventing the free vibration of the panels just at the most critical point, where the string vibrations are received from the feet of the bridge. With a given panel composition and thickness, the construction embodied in this invention provides more panel vibration and the consequent radiation of more sound and of improved quality of tone.

While the preceding disclosure will make the essentials of this invention of practice violin and bow clear to one skilled in the art of musical instrument construction, alternative details in construction and materials may be made within the spirit of the invention and the scope of the appended claims.

I claim:

1. For introductory or practice purposes, a body for a violin-type stringed instrument having a neck and a tailpiece, comprising a pair of arched panels spaced approximately parallel to one another to form the top and bottom surfaces of the body, a longitudinal rib separating the body panels, a pair of clamping means for securing at spaced localized areas said neck and said rib in longitudinal alignment, said top panel being fastened at one end by said pair of clamping means between said neck and said rib, said bottom panel being fastened at one end to said rib by at least one of said pair of clamping means, a third clamping means fastening said tailpiece and the other ends of said top panel, said rib, and said bottom panel, respectively, at a third localized area, said panels being otherwise unsupported and free at their peripheries, and a sound post positioned between the panels, the length of said post being sufficient to arch and separate the central portions of the panels from said rib.

2. A practice instrument body according to claim 1, in which the panels are composed of tempered hardboard.

3. A practice instrument body according to claim 1, in which said securing means comprise nuts and bolts.

4. A bow for a violin-type stringed instrument comprising a shaft having string retaining guide means at its extremities, bow strings wound around the shaft through the string retaining guide means in loops extending lengthwise of the shaft, and a spacer or frog slidably positioned between the shaft and the playing strings on one side of the shaft.

5. A bow for a violin-type stringed instrument according to claim 4 wherein said string retaining guide means comprises notches at the extremities of the shaft.

6. A bow for a violin-type stringed instrument according to claim 4, further including wrapping or covering means whereby bow strings on the opposite side of the shaft from the playing strings are secured to the bow shaft.

7. For introductory or practice purposes, the combination of a violin-type stringed instrument having a body comprised of a pair of arched panels spaced approximately parallel to one another to form the top and bottom surfaces of the body, means of securing said panels to the neck and tailpiece of the instrument, and a sound post positioned between the panels, the length of the post being sufficient to arch and separate the central portions of the panels, together with a bow for a violin-type stringed instrument comprising a shaft having string retaining guide means at its extremities, bow strings wound around the shaft through the string retaining guide means in loops extending lengthwise of the shaft, and a spacer or frog slidably positioned between the shaft and the playing strings on one side of the shaft.

* * * * *